US005173168A

United States Patent [19]

van Haastrecht et al.

[11] Patent Number: 5,173,168

[45] Date of Patent: Dec. 22, 1992

[54] METHOD OF MAKING IRON FOIL BY ELECTRODEPOSITION

[75] Inventors: Gijsbertus C. van Haastrecht, Heemskerk; Joop N. Mooij, Castricum, both of Netherlands

[73] Assignee: Hoogovens Groep B.V., Ijmuiden, Netherlands

[21] Appl. No.: 832,890

[22] Filed: Feb. 10, 1992

[30] Foreign Application Priority Data

Feb. 27, 1991 [NL] Netherlands ..... 9100352

[51] Int. Cl.[5] ..... C25D 1/04

[52] U.S. Cl. ..... 205/77; 204/206; 205/101; 205/256

[58] Field of Search ..... 205/76, 77, 99, 101, 205/256; 204/206

[56] References Cited

U.S. PATENT DOCUMENTS

| | | | |
|---|---|---|---|
| 3,793,165 | 2/1974 | Juda et al. | 204/106 |
| 4,793,902 | 12/1988 | Furuya et al. | 205/77 |
| 4,900,406 | 2/1990 | Janssen et al. | 205/138 |
| 5,082,538 | 1/1992 | DeRespiris et al. | 205/140 |

FOREIGN PATENT DOCUMENTS 0346981 12/1989 European Pat. Off. .

OTHER PUBLICATIONS

Patent Abstracts of Japan vol. 13, No. 21 (C-560) [3369] Jan. 18, 1989, C. Furuya.

*Primary Examiner*—John Niebling
*Assistant Examiner*—William T. Leader
*Attorney, Agent, or Firm*—Stevens, Davis, Miller & Mosher

[57] ABSTRACT

Iron foil is made by deposition of iron in an electrochemical cell having an insoluble anode from an acid electrolyte onto a moving cathode by the reaction:

$$Fe^{2+} + 2e^- \rightarrow Fe \text{ (foil)} \quad \text{(I)},$$

and removing the iron foil so made from the cathode. In a regenerator iron is dissolved into the electrolyte. To avoid reduction of the foil by $Fe^{3+}$ in the electrolyte, hydrogen in the form of hydrogen gas or a gas containing hydrogen is supplied to the anode, the anode being such that the anode reaction:

$$H_2 \rightarrow 2H^+ + 2e^- \quad \text{(II)}$$

takes place, said reaction (II) predominating at the anode over the reaction:

$$2Fe^{2+} \rightarrow 2Fe^{3+} + 2e^- \quad \text{(IV)}.$$

The dissolution of iron in the regenerator takes place at least partly by the reaction:

$$Fe + 2H^+ \rightarrow Fe^{2+} + H_2 \quad \text{(III)}.$$

8 Claims, 2 Drawing Sheets

METHOD OF MAKING IRON FOIL BY ELECTRODEPOSITION

BACKGROUND OF THE INVENTION

1. Field of the Invention

The invention relates to a method of making iron foil by electrodeposition, wherein in an electrochemical cell having a non-soluble anode iron is deposited from an acid electrolyte onto a moving cathode, and the iron deposited onto the cathode is removed in the form of a foil.

2. Description of the Prior Art

Such a method is known from the article "Electrolytic Iron Foil" by P. K. Subramanyan and W. M. King in "PLATING AND SURFACE FINISHING" of February 1972, pages 48 through 51. According to that article in principle the following reactions occur:

$$\text{at the cathode: } Fe^{2+}+2e^{-}\rightarrow Fe\ (\text{foil}) \quad (I)$$

$$\text{at the anode: } 2Fe^{2+}\rightarrow 2Fe^{3+}+2e^{-} \quad (IV)$$

$$\text{in the regenerator: } 2Fe^{3+}+Fe\rightarrow 3Fe^{2+} \quad (V)$$

A disadvantage of the known method, already indicated in the said article, is the simultaneous occurrence of the reaction:

$$\text{in the regenerator: } Fe+2H^{+}Fe^{2+}+H_2 \quad (III)$$

As a result of this, more $Fe^{2+}$ions are dissolved in the electrolyte than are deposited. The surplus $Fe^{2+}$ ions have to be drained off A more serious problem is that the pH of the electrolyte increases because of the consumption of hydrogen ions so that $Fe(OH)_3$ deposition occurs.

In order to solve this problem Belgian patent BE No. 8700832 describes use of two levels of temperature, the electrodeposition in the case of an electrolyte based on iron chloride, and a low temperature for the regeneration of the electrolyte. This suppresses reaction (III). However, the problem with this process is that before regeneration the electrolyte has to be cooled and then after regeneration re-heated. This takes a great deal of energy which is not acceptable for a product whose cost price already consists for a large part of energy costs.

In order to solve this problem, Japanese patent application Nos. JP-A No. 61-111159 and JP-A No. 61-111160 as well as BE No. 8700832 mentioned above propose adding an organic substance to the electrolyte, the effect of which is likewise suppression of reaction (III).

However, a problem with the prior art practice discussed above is that the electrodeposition relies on the reactions (I), (IV) and (V). Because of the presence of $Fe^{3+}$ions in the electrolyte, the following reaction occurs at the cathode:

$$Fe(\text{foil})+2Fe^{3+}\rightarrow 3Fe^{2+} \quad (VI)$$

The result is that iron foil already deposited goes back into solution so that the output of the electrodeposition process is reduced. In order to suppress this reaction as much as possible, the electrolyte circulation through the regenerator is increased in order to keep the concentration of $Fe^{3+}$ions in the electrolyte at a low level. However, much pumping energy is needed for this circulation which, for the above-mentioned reason, is not acceptable.

SUMMARY OF THE INVENTION

The object of the invention is to provide an improved method for manufacturing iron foil by means of electrodeposition which at least partly solves the above-mentioned problems.

According to the invention there is provided a method of making iron foil by electrodeposition wherein, in an electrochemical cell having an insoluble anode, iron is deposited from an acid electrolyte onto a moving cathode by the reaction:

$$Fe^{2+}+2e^{-}\rightarrow Fe\ (\text{foil}) \quad (I),$$

the iron foil so made is removed from the cathode and in a regenerator iron is dissolved into the electrolyte, wherein (i) hydrogen in the form of hydrogen gas or a gas containing hydrogen is supplied to the anode, the anode being such that the anode reaction:

$$H_2\rightarrow 2H^{+}+2e^{-} \quad (II)$$

takes place, said reaction (II) predominating at the anode over the reaction:

$$2Fe^{2+}\rightarrow 2Fe^{3+}+2e^{-} \quad (IV),$$

and (ii) the dissolution of iron in the regenerator takes place at least partly by the reaction:

$$Fe+2H^{+}\rightarrow Fe^{2+}+H_2 \quad (III).$$

Preferably the rate of reaction (II) at the anode is at least three times the rate of reaction (IV), and if feasible reaction (IV) is wholly suppressed.

In the regenerator, by making use of the $H^{+}$ions formed in reaction (II), iron is brought into solution according to the reaction (III) and replaces $Fe^{2+}$ions consumed in the reaction (I).

It has been found that, because of the addition of hydrogen to the anode and the occurrence of reaction (II) there, the reaction (IV) in which $Fe^{3+}$forms, does not occur or is minor. As the result of the absence of $Fe^{3+}$ions, or a very low concentration of $Fe^{3+}$ions, the reactions (V) and (VI) can no longer occur and the reaction (V) is essentially replaced by reaction (III). With the invention, the reaction (III) which was regarded as undesirable in the prior art is the reaction occurring in the regenerator. In the regenerator iron, for example in the form of scrap, can be dissolved are fully or almost fully converted into the form of the product iron foil.

In a preferred embodiment of the invention the hydrogen gas formed in the regenerator is collected and then supplied to the anode for reaction (III). Preferably the anode has a catalyst for reaction (II).

As the anode suitable for causing reaction (II) it is preferable that the anode is a porous anode carrying a catalyst and has means for feeding the hydrogen gas or gas containing hydrogen to a face of said anode directed away from said cathode, so that the gas contacts the electrolyte in pores of said anode and at the boundary of the gas, the electrolyte and the anode the reaction (II) takes place under the influence of the catalyst.

Such an anode is known as a gas diffusion anode. It is noted that in Dutch patent application NL-A No. 8801511 it is already proposed to use a so-called gas diffusion anode in an electrodeposition process. This prior art proposal is concerned with suppression of reaction $$2H_2O \rightarrow 4H^+ + 4e^- + O_2 \qquad \text{(VII)}$$

occurring at the insoluble anode during tinplating in order to improve the limited service life of the insoluble anode which was shortened as a result of corrosion by the oxygen formed. However, the present invention concerns suppression of reaction (IV) at the anode.

The advantages obtainable by the invention are as follows:

With the method in accordance with the invention the concentration of the $Fe^{3+}$ions in the electrolyte can be kept very low and in any case much lower than the maximum permissible concentration of 3 kg/m$^3$ which is required in connection with the quality of the foil.

Because of the low $Fe^{3+}$ion concentration in the electrolyte the parasitic reaction (VI) does not occur or occurs only slightly, so that the output from the electrodeposition process is high.

With the method in accordance with the invention it is possible to work at a higher $H^+$concentration than in prior art proposals. The electrolyte then has high conductivity and the process consumes less energy.

With the above-mentioned conditions of low $Fe^{3+}$-concentration and high $H^+$concentration, no deposition of $Fe(OH)_3$ takes place.

With the method in accordance with the invention the voltage between the anode and the cathode may be approximately 1 volt lower than with prior art proposals. Consequently with the invention energy consumption is considerably lower.

In the prior art, draining off electrolyte is necessary because of reaction (III). With the invention this is not necessary. This means much lower risk of environmental pollution.

With the method in accordance with the invention no organic substance is required for suppressing reaction (III). This has a favourable effect on the quality of the foil obtained.

It is preferable for the concentration of $Fe^{3+}$ions in the electrolyte to be less than 1 kg/m$^3$, and more preferably less than 0.2 kg/m$^3$. At that concentration it is certain that $Fe(OH)_3$ will not deposit.

Preferably the pH of the electrolyte is less than 2. This gives the electrolyte high conductivity. However, in practice it may be preferable to maintain the pH not lower than 1, because of corrosion of installation parts.

INTRODUCTION OF THE DRAWINGS

The invention will be illustrated by reference to the accompanying drawings and by a nonlimitative Example. In the drawings:

FIG. 1 shows an apparatus for the manufacture of iron foil by electrodeposition by the method of the invention, and FIG. 2 shows a detail of a gas diffusion anode used in the apparatus of FIG. 1.

DESCRIPTION OF THE PREFERRED EMBODIMENT

Figure 1:
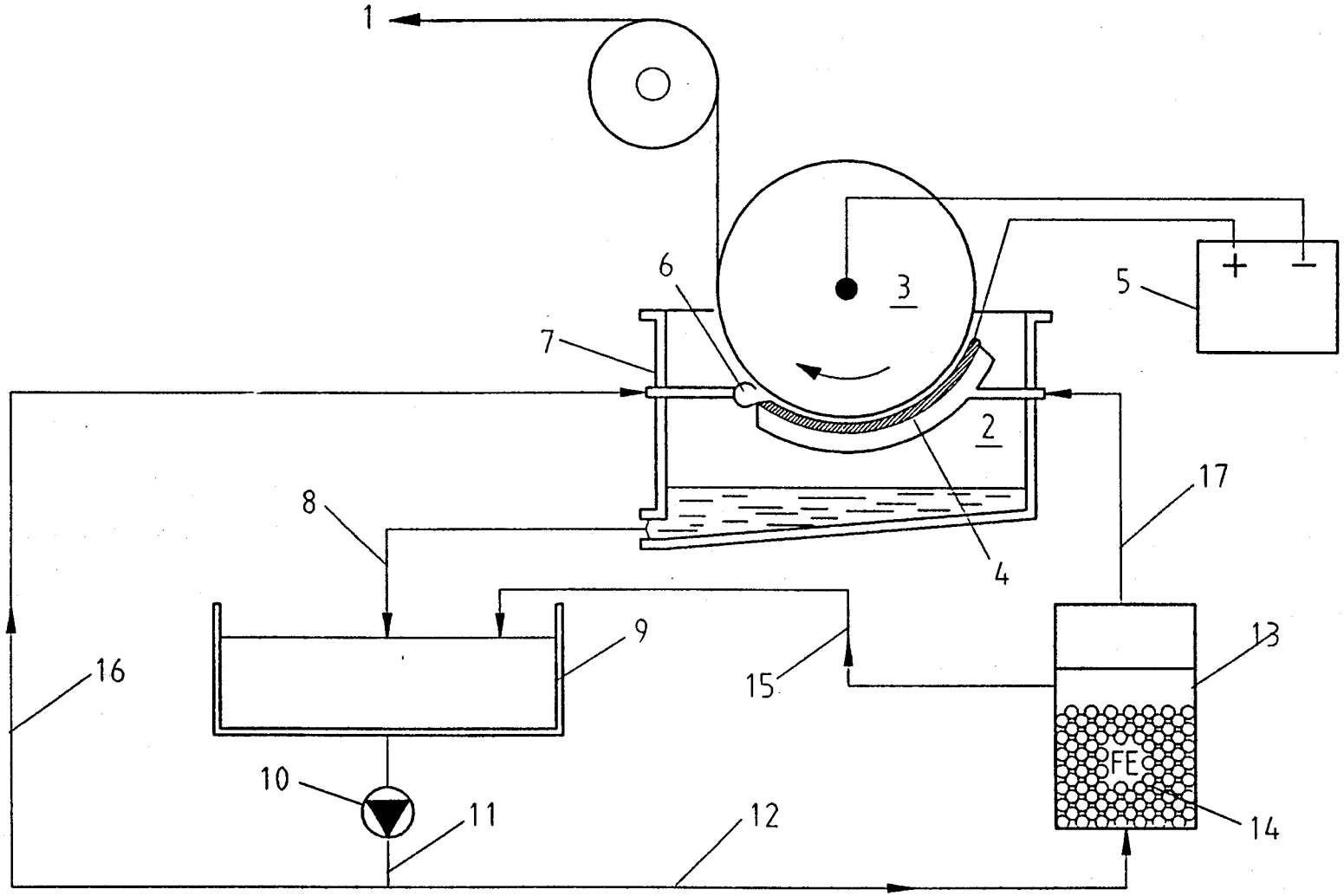

FIG. 1 shows an iron foil 1 being manufactured in an electrochemical cell 2 comprising a rotating roller 3 and an anode 4. The anode 4 shown in FIG. 1 is a radial type anode but it may also be flat. The roller 3 and the anode 4 are connected to the negative and positive poles respectively of a voltage supply 5. This permits the roller to function as cathode in the electrochemical cell 2. Electrolyte is supplied at 6 at the gap between cathode roller 3 and anode 4 and flows along the gap. The whole assembly is placed in a tank 7. On the cathode roller 3 according to reaction (I) iron is deposited out from the electrolyte. The iron is removed from the cathode in the form of the foil 1. The consumed and Fe-ion impoverished electrolyte is collected at the bottom of the tank 7 and taken by means of a pipe 8 to a circulation tank 9. The electrolyte is conveyed by a pump 10 through pipes 11 and 12 to a regenerator 13 where scrap 14 dissolves and enriches the electrolyte with iron ions according to reaction (III). The electrolyte thus enriched is returned to the electrochemical cell by means of a pipe 15, the circulation tank 9 and pipes 11 and 16.

In the apparatus shown in FIG. 1 the hydrogen gas formed and collected according to reaction (III) in the regenerator 13, is conveyed, optionally after scrubbing, by means of a pipe 17 to the anode 4 and to that side of anode 4 facing away from the cathode 3 for consumption in the reaction (II). The anode 4 used in the apparatus is a hydrogen gas diffusion anode which is described below.

Figure 2:
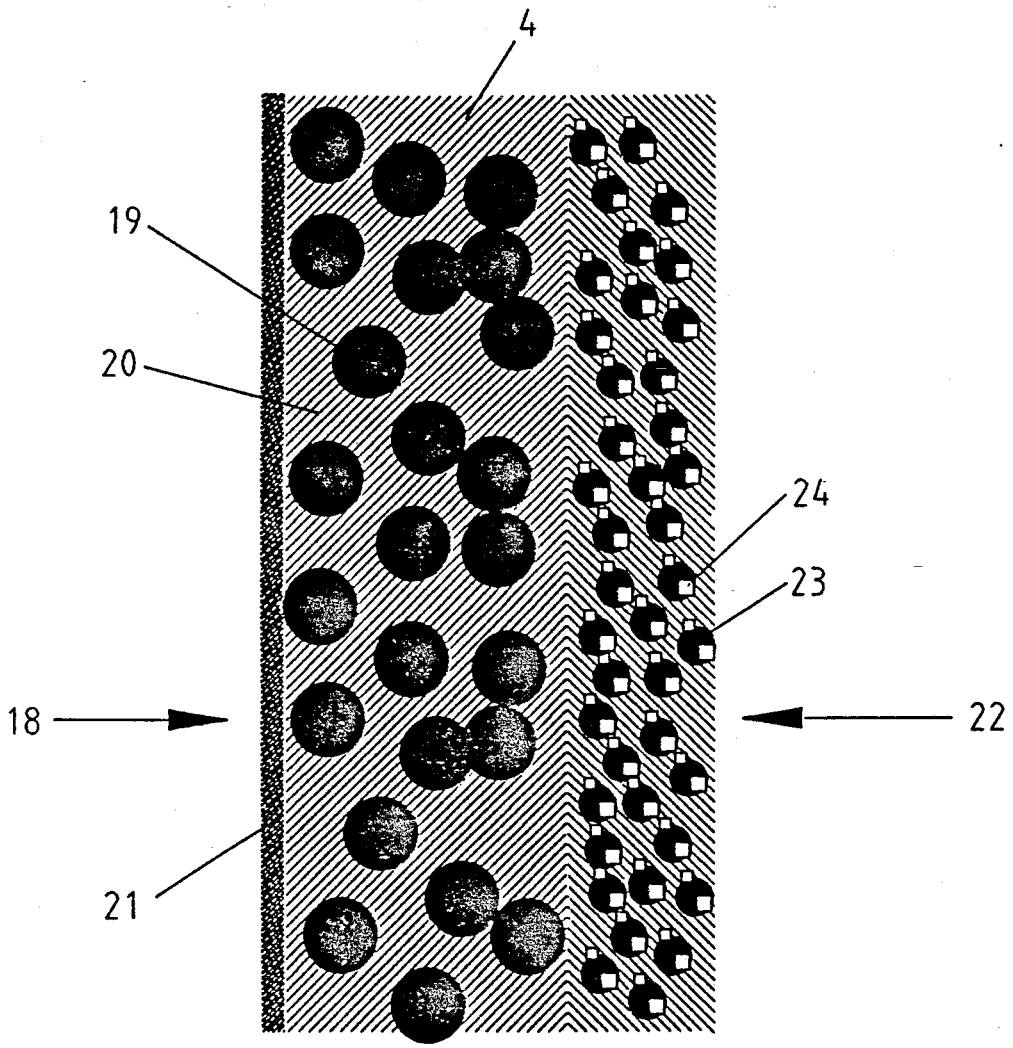

FIG. 2 shows the principle of the hydrogen gas diffusion anode. The anode 4 has a hydrophobic part 18 where the gas containing hydrogen is taken to the anode on the side of the anode facing away from the cathode. This part has coarse pores. In a specific embodiment the hydrophobic part consists of active carbon 19 held in a Teflon matrix 20 and the hydrophobic part is provided with a layer of Carbon Felt 21 Torag paper to help support the electrode and to help conductivity.

Further, the anode 4 has on the electrolyte side, a hydrophilic part 22 with fine pores and a catalyst on the electrolyte side. In a specific embodiment the hydrophilic part consists of active carbon 23 loaded with platinum 24 as catalyst, in a Teflon matrix and is 70 to 120 μm thick. The reaction (II) takes place in the fine pores at the three-way boundary surface of the gas containing hydrogen, electrolyte and active carbon 23. Under the influence of the catalyst 24, $H^+$ions form at this boundary surface. The gas containing hydrogen may be a mixture of hydrogen with one or more other gases or a compound of hydrogen such as natural gas, for example. However, preference is given to a gas containing hydrogen that consists essentially of hydrogen.

EXAMPLE

In this example iron foil is manufactured using an apparatus such as shown in FIGS. 1 and 2.

Using a strip width of 1,000 mm and a strip velocity of 10 m/min an iron foil with a thickness of 20 μm is produced. Use is made of an electrolyte containing chloride ions and iron with a pH of about 1.8. The concentrations of the ions are:

| | |
|---|---|
| $Fe^{2+}$ | 250 g/l |
| $Fe^{3+}$ | 3 g/l |
| $Cl^-$ | 300-350 g/l |

The hydrogen consumption is about 3.6 kg per hour. The temperature is 105° C., the current density 200 a?dm$^2$, the anode/cathode spacing 2 mm. The electrolyte velocity in the anode/cathode gap is 4 m/s. The voltage drop across the cell is 2.6 V.

At the anode, the ratio of the rate of reaction (II) to the rate of reaction (IV) is 10:1.

The anode consists of porous graphite and the catalyst on it is Pt. Fe is supplied into the regenerator. After a scrubbing process, the hydrogen gas released in the regenerator is supplied to the anode.

Similar processes have been successfully performed over a current density range from 100 to 200 A/dm$^2$ and an applied voltage range from 1 to 6 V. The anode/-cathode spacing is preferably 1 to 3 mm. In the processes, the maximum production capacity is approximately 94 kg/hour, being limited by the capacity of the current rectifier used which is approximately 90 kA. The thicknesses of the iron foil obtained lie typically in the range 10 to 60 μm.

What is claimed is:

1. Method of making iron foil by electrodeposition, comprising (i) passing current through an acid electrolyte in an electrochemical cell having an insoluble anode so as to cause iron to deposit from the electrolyte onto a moving cathode by the reaction:

$$Fe^{2+}+2e^- \rightarrow Fe\ (foil) \qquad (I),$$

(ii) removing the iron foil so made from the cathode, (iii) supplying hydrogen in the form of a gas selected from hydrogen gas and a gas containing hydrogen to the anode, the anode being such that the anode reaction:

$$H_2 \rightarrow 2H^{30}+2e^- \qquad (II)$$

takes place, said reaction (II) predominating at the anode over the reaction:

$$2Fe^{2+} \rightarrow 2Fe^{3+}+2e^- \qquad (IV),$$

and (iv) dissolving iron into the electrolyte in a regenerator at least partly by the reaction:

$$Fe+2H^+ \rightarrow Fe^{2+}+H_2 \qquad (III).$$

2. Method according to claim 1 wherein the rate of reaction (II) at the anode is at least three times the rate of reaction (IV).

3. Method according to claim 1 wherein said reaction (II) takes place at the anode under the influence of a catalyst.

4. Method according to claim 1 wherein said anode is a porous anode carrying a catalyst and has means for feeding said gas to a face of said anode directed away from said cathode, such that said gas contacts the electrolyte in pores of said anode and at the boundary of the gas, the electrolyte and the anode said reaction (II) takes place under the influence of said catalyst.

5. Method according to claim 1 wherein the concentration of $Fe^{3+}$ions in the electrolyte is less than 1 kg/m$^3$.

6. Method according to claim 5 wherein the concentration of $Fe^{3+}$ions in the electrolyte is less than 0.2 kg/m$^3$.

7. Method according to claim 1 wherein the pH of the electrolyte is less than 2.

8. Method according to claim 1 including supplying hydrogen gas formed in the regenerator in reaction (III) to the anode for reaction (II).

* * * * *